United States Patent [19]

Keller

[11] Patent Number: 4,726,123

[45] Date of Patent: Feb. 23, 1988

[54] GAME AND TARGET BOW SIGHT

[76] Inventor: Roy W. Keller, 2632 Wyoming Dr., Kannapolis, N.C. 28081

[21] Appl. No.: 945,922

[22] Filed: Dec. 23, 1986

[51] Int. Cl.[4] ..... F41G 1/00

[52] U.S. Cl. ..... 33/265

[58] Field of Search ..... 33/265

[56] References Cited

U.S. PATENT DOCUMENTS

| | | | |
|---|---|---|---|
| 2,669,023 | 2/1954 | Pizzuti | 33/265 |
| 2,982,026 | 5/1961 | Peterson | 33/265 |
| 4,224,741 | 9/1980 | Perry | 33/265 |
| 4,418,479 | 12/1983 | Stachnik | 33/265 |
| 4,532,717 | 8/1985 | Watson et al. | 33/265 |

*Primary Examiner*—Harry N. Haroian

*Attorney, Agent, or Firm*—Ralph H. Dougherty

[57] ABSTRACT

A rapidly adjustable bow sight, which includes a substantially vertical plate having an integral lever arm extending uwpardly and downwardly therefrom, a rotatable member journaled for rotation on the plate, a pin or blade extending horizontally from the rotatable member, and a connector arm pivotally attached to the upper extremity of the lever arm and to the rotatable member. The bow sight is adjustable with one finger of the hand grasping the bow, including while the bow string is drawn.

7 Claims, 3 Drawing Figures

GAME AND TARGET BOW SIGHT

BACKGROUND OF THE INVENTION

The present invention relates to the field of archery equipment, and more particularly to a sight for attachment to a bow to enable the rapid reorientation of the bow for aiming arrows at game or targets located at various distances from the archer.

Archery has been in vogue for hundreds of years, and is common to both hunters and sportsmen. Both groups have long been concerned with hitting their target or quarry, and thus devices for aiding and improving accuracy in archery are continuously being sought. Archery sights have been used for over fifty years, and they generally have been small items protruding from the bow on the same side as the arrow rest.

It has recently become important in hunting bows to have an adjustable sight. Most currently available sights, however, require two hands for adjustment, and the adjustment cannot be made while the bow string is drawn.

A multi-pin bow sight is shown in Saunders U.S. Pat. No. 4,584,777. It is very easy to utilize the wrong pin to sight the target or quarry and miss by a large margin as a result. A single pin sight is more accurate, because there is no confusion between pins or in the selection of the correct pin to use as the proper sight pin.

Little, in U.S. Pat. No. 4,587,945, teaches a pair of sight pins which are fixed into position by tightening nuts against lock washers. Each sight is set for a different distance, as adjusting the sight for different distance requires substantial manipulation with both hands.

Gaddy, in U.S. Pat. No. 4,616,422, teaches a multiple pin sight with a counterweighted wheel having an adjustable sight pin thereon, for use from an elevated shooting position. The regular sight pins are fixed, and present a confusing array of pins to the user.

SUMMARY OF THE INVENTION

I have developed a sight for a bow which is adjustable by the archer with one finger of the hand grasping the bow. The adjustment can be made at any time, including while the bow string is drawn, in order to shoot at a different target from the originally intended target. In addition, I provide an easily readable distance gauge. The invented sight is readily attachable and detachable from a bow.

Many bows have provision for attaching a bow sight by placing the sight in a dove tailed slot or similar mating device and tightening a retaining nut. The present invention is readily adaptable to such apparatus.

OBJECTS OF THE INVENTION

It is the principal object of this invention to overcome the disadvantages of prior art devices and to provide an easily adjustable bow sight.

It is another object of this invention to provide a bow sight which can be readily adjusted by the archer at any time with but a single finger.

It is also on object of this invention to provide a bow sight which is readily attachable to and detachable from a bow.

BRIEF DESCRIPTION OF THE DRAWINGS

The foregoing and other objects of the invention will become more readily apparent by referring to the following detailed description and the appended drawings, in which.

DETAILED DESCRIPTION

Figure 1:
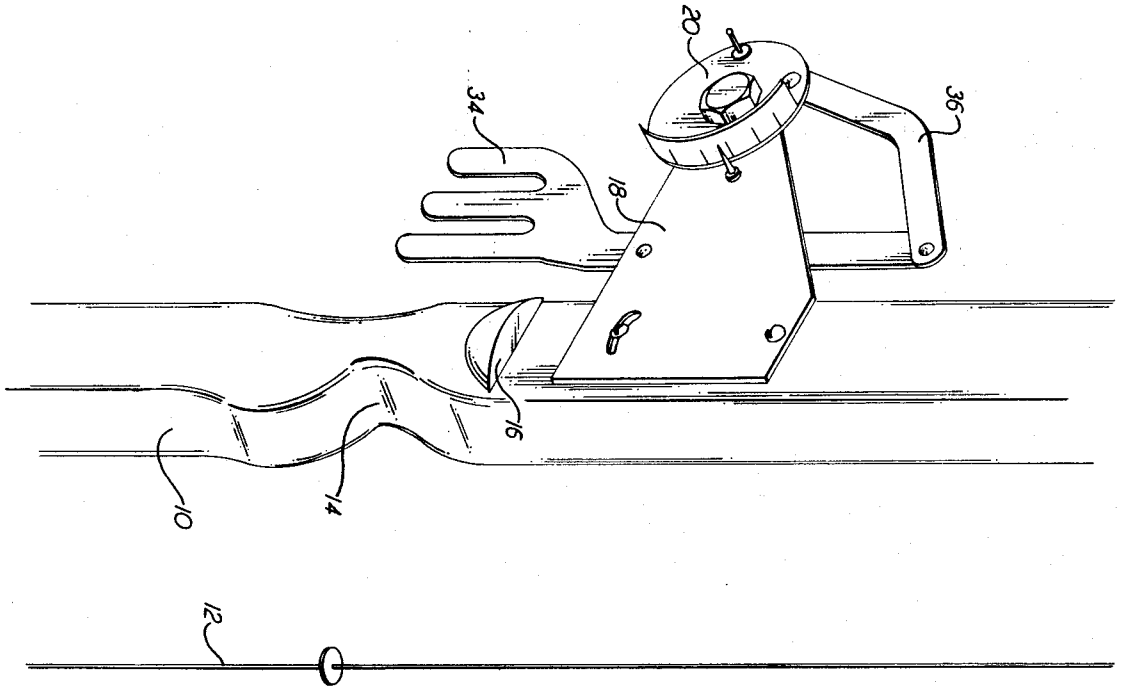
FIG. 1 is an isometric elevational view of a hunting bow with the invented bow sight mounted thereon.

Referring now to FIG. 1, a bow 10 is strung with a bow string 12. The bow generally contains a hand grip 14 and often has an arrow rest 16 at the top of the hand grip. The bowstring 12 may be provided with an arrow rest 17, and a rear sighting device 18, if desired.

Figure 2:
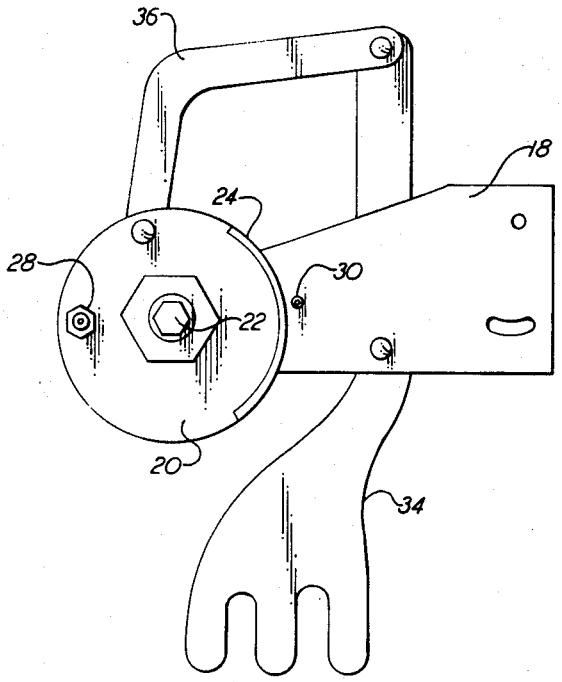
FIG. 2 is a side elevational view of the invented bow sight.
Figure 3:
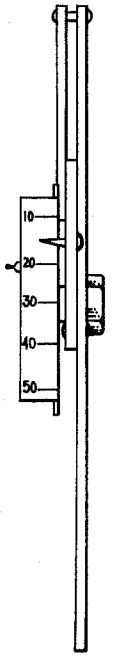
FIG. 3 is a right hand view (or rear view) of the bow sight as depicted in FIG. 2.

A support member or plate 20, adapted for mounting on a bow, extends generally forward and perpendicular from the bow 10. At the end of the member 20 away from the bow, a disk-like rotatable member 22 is mounted on an axle 24 which is journaled for rotation about its axis, said axle being mounted in an orifice in support member 20. The rotatable member 22 carries a distance indicator 26 at its side nearer the bow, and also carries a blade sight 28 near the extremity away from the bow. An index member 30 protrudes from and is affixed to the support member 20. A manipulative lever arm 34 is pivotally connected to the support member 20 at pivot 35 intermediate the ends of the support member, and extends both above and below the support member. At the upper extremity of the lever arm 34, a connector arm 36 is pivotally attached at pivot 38. The opposite end of the connector 36 arm is pivotally attached to the disk-like rotatable member 22 through pivot 40. Connector arm 36 can be straight, as shown in FIG. 1, or can be curved, as shown in FIG. 2, which allows a smaller and thus shorter, sighting device.

The lower end of lever arm 34 advantageously carries two or more fingers 42, for engagement by the operator's fingers to make quick and accurate adjustments of the sighting device by moving the sight pin 28 in either direction.

In an alternative embodiment, the sighting device can be mounted on the bow by use of a clamping member held in place by wing nuts or thumb screws.

The support member can be either an L-shaped plate, a T-shaped plate wherein the T is attached to the bow either by fixed means or removable means, such as clamps.

SUMMARY OF THE ACHIEVEMENTS OF THE OBJECTS OF THE INVENTION

From the foregoing, it is clear that I have invented an easily adjustable bow sight, which can be adjusted at any time by the user with but a single finger, and which is readily attachable to and detachable from a bow.

What is claimed is:

1. An archery bow sight for attachment to a bow comprising;

a. a base, said base being a substantially vertical plate, said plate carrying a lever arm pivotally attached thereto, and extending upwardly and downwardly therefrom;

b. a rotatable substantially round disc member journaled for rotation on said base plate;

c. a pin or blade extending horizontally from said rotatable disc member, which pin or blade acts as the reference point for sighting;

d. a connector arm pivotally attached to the upper extremity of said lever arm and to said rotatable disc member at its periphery;

e. means for attaching said plate to a bow; and f. an arcuate scale normal to said disc and fixed thereto, and an index affixed to said plate, which together with said scale forms a distance indicator, whereby said distance indicator is in direct view of the user.

2. A bow sight apparatus in accordance with claim 1 wherein means for attaching said plate to a bow includes adjustment means.

3. A bow sight apparatus in accordance with claim 2 wherein said adjustment means comprises a slot in base plate adapted to receive a retaining screw engageable to said bow.

4. A bow sight apparatus in accordance with claim 1 wherein the lower end of said lever arm carries at least two downwardly extending fingers, whereby engagement by the operator's fingers can make quick and accurate adjustments of said pin or blade.

5. A bow sight apparatus in accordance with claim 1 wherein said means for attaching said plate to said bow is a clamping member held in place by wing nuts or thumb screws.

6. A bow sight apparatus in accordance with claim 1 wherein said base plate is L-shaped.

7. A bow sight apparatus in accordance with claim 1 wherein said base plate is T-shaped.

* * * * *

UNITED STATES PATENT AND TRADEMARK OFFICE

CERTIFICATE OF CORRECTION

PATENT NO. : 4,726,123

DATED : February 23, 1988

INVENTOR(S) : ROY WESTLEY KELLER

It is certified that error appears in the above-identified patent and that said Letters Patent is hereby corrected as shown below:

In column 3, line 6, change "index affixed" to -- index member affixed --.

In column 3, line 16, before "base", insert -- said --.

Signed and Sealed this

Twenty-second Day of November, 1988

*Attest:*

DONALD J. QUIGG

*Attesting Officer*

*Commissioner of Patents and Trademarks*